US005105226A

United States Patent [19]

Sugihara

[11] Patent Number: 5,105,226

[45] Date of Patent: Apr. 14, 1992

[54] DEVELOPER CARRIER OF A DEVELOPING DEVICE FOR AN IMAGE FORMING APPARATUS

[75] Inventor: Kazuyuki Sugihara, Kawasaki, Japan

[73] Assignee: Ricoh Company, Ltd., Tokyo, Japan

[21] Appl. No.: 599,084

[22] Filed: Oct. 17, 1990

[30] Foreign Application Priority Data

Oct. 20, 1989 [JP] Japan ..... 1-271643

[51] Int. Cl.[5] ..... G03G 15/09

[52] U.S. Cl. ..... 355/251; 29/132; 118/657; 355/259

[58] Field of Search ..... 355/259, 251, 245, 305; 29/132; 118/656, 657, 651

[56] References Cited

U.S. PATENT DOCUMENTS

| | | | |
|---|---|---|---|
| 4,023,899 | 5/1977 | Hayashi et al. | 355/256 |
| 4,250,605 | 2/1981 | Chapman | 29/132 |
| 4,268,943 | 5/1981 | Watanabe et al. | 118/651 X |
| 4,292,923 | 10/1981 | Huggins | 118/658 |
| 4,422,749 | 12/1983 | Hoshino et al. | 355/251 |
| 4,508,052 | 4/1985 | Kohyama | 118/651 |
| 4,564,285 | 1/1986 | Yasuda et al. | 355/259 X |
| 4,760,422 | 7/1988 | Seimiya et al. | 355/259 X |
| 4,827,868 | 5/1989 | Tarumi et al. | 355/259 X |

*Primary Examiner*—A. T. Grimley
*Assistant Examiner*—Nestor R. Ramirez
*Attorney, Agent, or Firm*—Oblon, Spivak, McClelland, Maier & Neustadt

[57] ABSTRACT

A developer carrier in the form of a developing roller constituting a part of one of a plurality of developing units incorporated in a color developing device which is mounted on an electrophotographic image forming apparatus. Latent images electrostatically formed on a photoconductive element included in the image forming apparatus each is developed by a magnet brush formed by the developer of particular color on associated one of the developing rollers. Each developing roller has a non-magnetic conductive base, a first layer formed on the base and having an insulation resistance greater than $10^6$ ohms, and a second layer formed on the first layer and having an insulation resistance lying in the range of $10^4$ ohms to $10^9$ ohms. The developing roller prevents a bias being applied thereto for development from leaking due to scratches or similar defects of the photoconductive element. While the developing device is in operation, a magnet brush is prevented from being formed on the developing rollers of those developing units which are not joining in the development.

14 Claims, 4 Drawing Sheets

DEVELOPER CARRIER OF A DEVELOPING DEVICE FOR AN IMAGE FORMING APPARATUS

BACKGROUND OF THE INVENTION

The present invention relates to a developing device for an electrophotographic image forming apparatus and, more particularly, to a developer carrier on which a magnet brush is selectively formed by a developer for developing a latent image electrostatically formed on the surface of a photoconductive element, or image carrier, and representative of a document image.

Electrophotographic image forming apparatuses such as a copier, facsimile transceiver and printer are extensively used today. In an electrophotographic copier, for example, a latent image representative of a document image is electrostatically formed on a photoconductive element and then developed by a toner or similar developer. For example, a two-component developer which is a mixture of toner and carrier forms a magnet brush on the surface of a developer carrier forming a part of a developing device and implemented as a developing roller. The magnet brush is caused into contact with the latent image. Then, the toner contained in the developer is selectively deposited on the latent image on the basis of the potential pattern of the latent image. Usually, a bias for development is applied to the developing roller. A toner image produced by the above procedure is transferred to a paper sheet or similar medium by a transferring device and then fixed on the medium by a fixing device of the type using a heater by way of example.

Assume that a conductive base constituting the photoconductive element is exposed to the outside due to scratches or similar defects formed in the surface of the photoconductive element. Then, the magnet brush deposited on the developing roller makes contact with the exposed base of the photoconductive element and thereby causes the bias being applied to the roller to leak, resulting in defective reproductions.

Providing an insulating layer on the surface of the developing roller is an approach proposed in the past for eliminating the above problem. Although this kind of approach is successful in eliminating the leak of the bias, it brings about another problem since the insulating layer is charged due to the friction thereof with the developer. Specifically, a color electronic copier or similar image forming apparatus usually has a developing device which is made up of two or more developing units. In this type of apparatus, while one of the developing units is in operation, the others are held in an inoperative condition. Therefore, a prerequisite is that the magnet brush be formed only on the developing roller of the operative developing unit and not on the developing rollers of the inoperative developing units. However, once the insulating layer provided on the developing roller for the above purpose is charged due to its friction with the developer, the developer is electrostatically deposited on the charged insulated layer. As a result, the magnet brush is unwantedly formed on the developing rollers of the inoperative developing units. For this reason, it has been customary to simply replace the defective photoconductive element or to repair it in place of adopting the insulating layer scheme.

SUMMARY OF THE INVENTION

It is therefore an object of the present invention to provide a developer carrier of a developing device for an image forming apparatus which prevents a bias being applied to the developer carrier for development from leaking to the outside due to scratches or similar defects of a photoconductive element.

It is another object of the present invention to provide a developer carrier of a developing device for an image forming apparatus which prevents a developer from forming an unwanted magnet brush on the developer carriers of inoperative developing units.

It is another object of the present invention to provide a generally improved developer carrier of a developing device for an image forming apparatus.

In accordance with the present invention, a magnet brush forming agent carrier having a surface for allowing a magnet brush forming agent to form a magnet brush thereon comprises a non-magnetic conductive base, a first layer formed on the base and having a predetermined insulation resistance, and a second layer formed on the first layer for defining the surface of the magnet brush forming agent carrier and having a predetermined insulation resistance.

Also, in accordance with the present invention, in a multi-color developing device having at least two developing units for developing latent images electrostatically formed on an image carrier by using developers of at least two colors, the developing units each comprising a developer carrier for carrying a magnet brush formed by particular one of the developers, the developer carriers each comprises a non-magnetic conductive base, a first layer formed on the base and having an insulation resistance greater than $10^6$ ohms, and a second layer formed on the first layer and having an insulation resistance ranging from $10^4$ to $10^9$ ohms.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
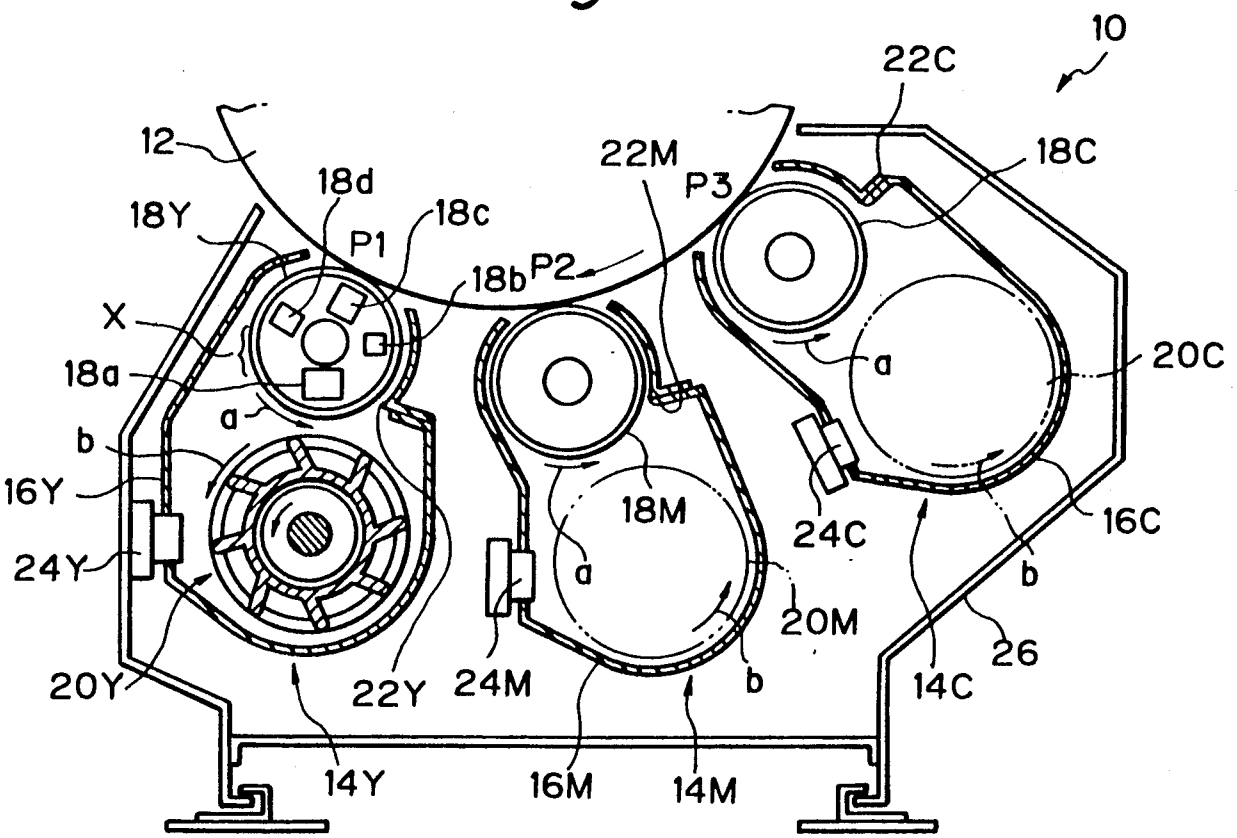
FIG. 1 is a vertical section of a color developing device to which the present invention is applicable.
Figure 2:
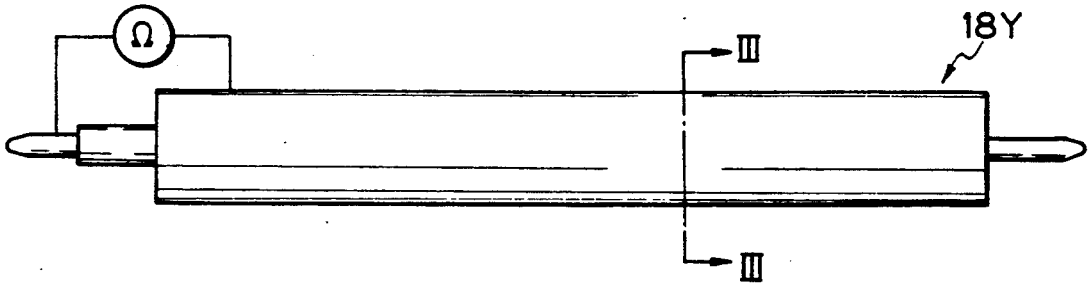
FIG. 2 is a perspective view of an image carrier embodying the present invention and implemented as a developing roller for used in the device shown in FIG. 1.

Referring to FIG. 1 of the drawings, a developing device for an image forming apparatus and implemented with an image carrier embodying the present invention is shown and generally designated by the reference numeral 10. The developing device 10 may be incorporated in a color electrophotographic copier, for example, so as to develop a latent image electrostatically formed on the surface of a photoconductive element 12 and representative of a document image. In the specific construction shown in FIG. 1, the photoconductive element 12 is implemented as a drum.

The developing device 10 has developing units 14Y, 14M and 14C which are arranged around the drum 12 and in close proximity to each other. The developing units 14Y, 14M and 14C are respectively loaded with a yellow, a magenta and a cyan developer and, in this sense, they will hereinafter be referred to as a yellow, a magenta and a cyan developing unit, respectively. The yellow, magenta and cyan developers each is a two-component developer, i.e., a combination of toner and carrier. Since the developing units 14Y, 14M and 14C have an identical configuration, let the following description concentrate on the yellow developing unit 14Y by way of example. The yellow developing unit 14Y has a casing 16Y which stores the yellow developer therein. A developing roller 18Y and a developer transport member 20Y are accommodate in the casing 16Y and rotatable in directions indicated by arrows a and b, respectively. The developing roller 18Y serves as a developer carrier embodying the present invention and has magnets **18*a*, 18*b*, 18*c* and 18*d* thereinside. A doctor blade 22Y is constituted by a part of the casing 16Y to regulate the amount of developer being supplied to the surface of the developing roller 18Y. A toner concentration sensor 24Y is affixed to the casing 16Y for sensing the concentration of toner in the developer. The magnet 18*a* attracts the developer supplied from the developer transport member 20Y onto the surface of the developing roller 18Y, while the magnet 18*b* transports the attracted developer to a developing region P1. In the developing region P1, the magnet 18*c* causes the developer to form a magnet brush on the surface of the developing roller 18. The magnet 18*d* attracts the developer remaining on the developing roller 18Y and thereby prevents it from being scattered around. The developing units 14Y, 14M and 14C are accommodated in a framework 26 to constitute a single unit which is removable from the body of the color copier. Developing unit 14M and 14C are similar to developing unit 14Y such that 16M and 16C respectively represent the casing for each of the developing units 14M and 14C; 22M and 22C respectively represent the doctor blades for each of the developing units; and 24M and 24C** respectively represent the toner concentration sensors for each of the developing units.

In operation, as the developer transport member 20Y of the yellow developing unit 14Y is rotated in the direction b, the yellow developer is fed to the surface of the developing roller 18Y which is rotating in the direction a, i.e. counterclockwise as viewed in the figure. When the developer is transported to the developing region P1 by the roller 18Y, the magnet brush formed by, among other, the magnet **18*c* contacts the latent image on the drum 12 to thereby develop it. As a result, a yellow toner image is formed on the drum 12. This toner image is transferred to a paper sheet or similar medium, not shown, by an image transferring device, not shown. The developer remaining on the roller 18Y after such image transfer is let fall and collected as it reaches a region X where no magnets exist, i.e., where the magnetic attraction is weak. Subsequently, in the magenta developing unit 14M, a developer transport member 20M supplies the magenta developer to the surface of a developing roller 18M which is rotating counterclockwise as indicated by an arrow a. As soon as the developing roller 18M transports the developer to a developing region P2, the resulting magnet brush contacts an electrostatic latent image also formed on the drum 12 to turn it into a magenta toner image. It is to be noted that at the time of the development by the magenta developing unit 14M the rotation of the developing roller 18Y has been reversed to remove the yellow developer from the roller 18Y. This frees the magenta developing unit 14M from the influence of the yellow developing unit 14Y. The magenta toner image is transferred from the drum 12 to the paper sheet over the yellow toner image by the image transferring device. Afterwards, in the cyan developing unit 14C, a developer transport member 20*c* supplies the cyan developer to a developing roller 18*c* which is rotating counterclockwise as indicated by an arrow a. As the cyan developer reaches a developing region P3, it forms a magnet brush and develops an electrostatic latent image formed on the drum 12. The resulting cyan toner image is transferred from the drum 12 to the paper sheet over the yellow and magenta toner images. Again, at the time of the development by the cyan developing unit 14C, the rotation of the developing roller 18M has been reversed to remove the magenta developer therefrom and, therefore, the cyan developing unit 14C is free from the influence of the magenta developing unit 14M**.

By the above-described procedure, toner images of different colors are sequentially formed on the drum 12 and transferred to a paper sheet to form a composite color image thereon.

A preferred embodiment of the image carrier in accordance with the present invention will be described which is implemented as a developing roller for use in the color developing device 10. While the following description will also concentrate on the developing roller 18Y of the yellow developing unit 14Y, the illustrative embodiment is of course applicable to the other developing rollers 18M and 18C.

Figure 3A:
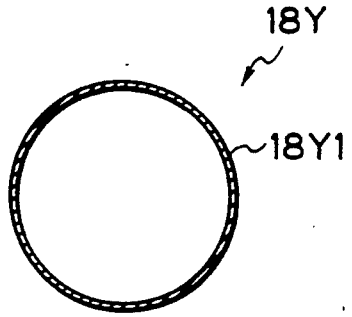
FIGS. 3A to 3C are cross-sections showing a specific configuration of the developing roller of FIG. 2.
Figure 3B:
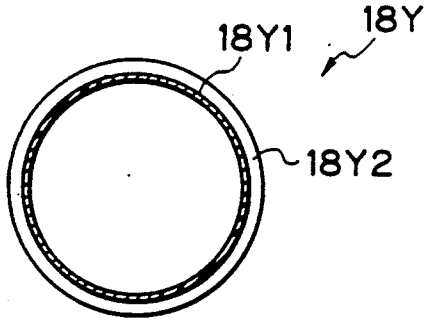
Figure 3C:
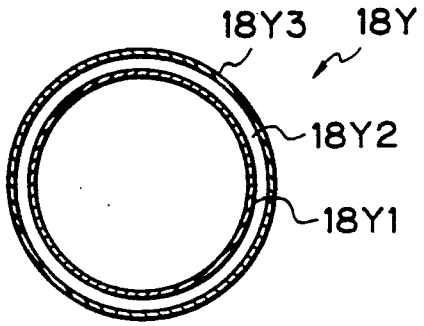

Referring to FIGS. 2 and 3A to 3C, the developing roller 18Y has a non-magnetic conductive base 18Y1 which is a sleeve-like extrusion of aluminum. The conductive base 18Y1 along is shown in a cross-section in FIG. 3A. As shown in FIG. 3B, an insulating layer 18Y2 having an insulation resistance of $10^9$ ohms is formed on the surface of the base 18Y1 by hard alumite (HAl) processing. The insulating layer 18Y2 is coated with a conductive agent, or anti-static electricity paint, whose insulation resistance is $10^6$ ohms so as to form a conductive layer or coating 18Y3, as shown in FIG. 3C. The conductive agent may be implemented as ELECTROPACK, available from Daishin Kako, Co., Ltd. (Japan). ELECTROPACK ® is generically known as an anti-static electricity paint and is a conductive agent having a surface resistance of $10^6$ ohms. Specifically, ELECTROPACK is a liquid paint made up of ELECTROPACK 360A and Primer EX-115 which is a binder for binding ELECTROPACK 360A to the insulating layer 18Y2, and it frees an object from charges by dissipating static electricity tending to deposite thereon. After such a liquid paint has been sprayed onto the insulating layer 18Y2, the resultant laminate is baked at 100 to 150 degrees centigrade for 1 to 2 hours to complete the developing roller 18Y.

The developing roller 18Y having the above structure has the following advantages. When scratches or pin holes are formed in the surface of the drum 12, the insulating layer 18Y2 provided on the conductive base 18Y1 prevents a bias being applied to the roller 18Y for development from leaking via the carrier of the developer that forms in the magnet brush. The conductive coating 18Y3 covering the insulating layer 18Y2 prevents static electricity ascribable to the friction between the roller 18Y and the developer from accumulating on the surface of the roller 18Y. Hence, when the yellow developing unit 14Y with the developing roller 18Y is in an inoperative state during the course of operation of the developing device 10, the developer does not form the magnet brush at least on the surface of the roller 18Y.

Experiments showed that when the total insulation resistance of the layers 18Y2 and 18Y3 described above is selected to be $10^7$ ohms or so, the illustrative embodiment eliminates the leak of the bias and the formation of the magnet brush effectively. How thick the conductive coating 18Y3, or ELECTROPACK, should desirably be was also experimentally determined with respect to the above-mentioned insulation resistance of $10^7$ ohms or so, as will be described with reference to FIG. 4 hereinafter.

Figure 4:
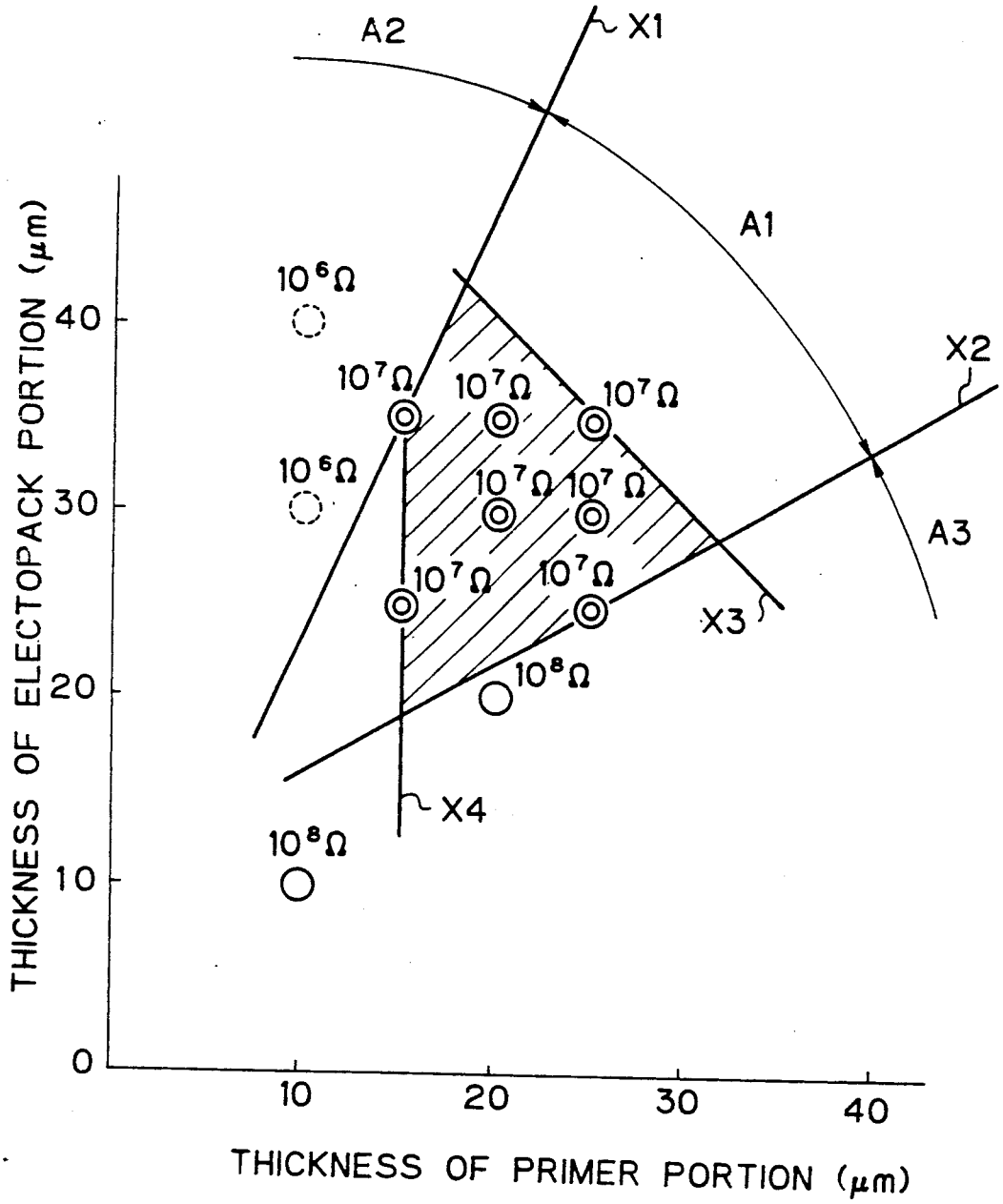
FIG. 4 is a graph showing a relation between the thickness of a conductive layer and that of a binding layer which constitute a conductive coating forming a part of the illustrative embodiment.

Let Primer EX-115 and ELECTROPACK 360A constituting ELECTROPACK as stated earlier be called respectively a Primer portion and an ELECTROPACK portion for the sake of illustration. In FIG. 4, the abscissa and the ordinate are representative of the thickness of the Primer portion and that of the ELECTROPACK portion, respectively. It was found by experiments that in a range A1 wherein the total insulation resistance of the two layers 18Y2 and 18Y3 is $10^7$ ohms, the leak of the bias and the formation of the magnet brush are effectively eliminated especially at the positions marked with double circles in the graph. More specifically, desirable results were achieved in the rectangular area of FIG. 4 indicated by hatching and delimited by a line X1 along which the region A1 borders a region A2 wherein the total insulation resistance is lower than $10^6$, a line X2 along which the region A1 borders a region A3 wherein the total insulation resistance is greater than $10^8$, a limit thickness line X3, and a limit coating performance line X4. It is to be noted that thicknesses of ELECTROPACK greater than "limit thickness line" mentioned above prevent the developing roller from being provided with necessary undulations. The results obtained at the positions marked with solid circles and dashed dotted circles in FIG. 4 were not satisfactory.

As FIG. 4 indicates, the illustrative embodiment is most effective when the Primer portion is 15 to 25 microns thick and the ELECTROPACK portion is 25 to 35 microns thick. Even when the insulation resistance of the insulating layer 18Y2 was changed from $10^9$ ohms to other values such as $10^6$ ohms, $10^7$ ohms and $10^8$ ohms, it was not necessary to change the thickness of the conductive coating or ELECTROPACK 18Y3. This means that the insulation resistance of the insulating layer 18Y2 needs only to be at least $10^6$ ohms. Further, it was also proved that the insulation resistances of conductive coating or ELECTROPACK 18Y3 lying in the range of at least $10^4$ to $10^9$ ohms are satisfactory.

Obviously, the conductive coating 18Y3 may be implemented with any other anti-static electricity paint so long as it has characteristics comparable with those of ELECTROPACK.

Figure 5:
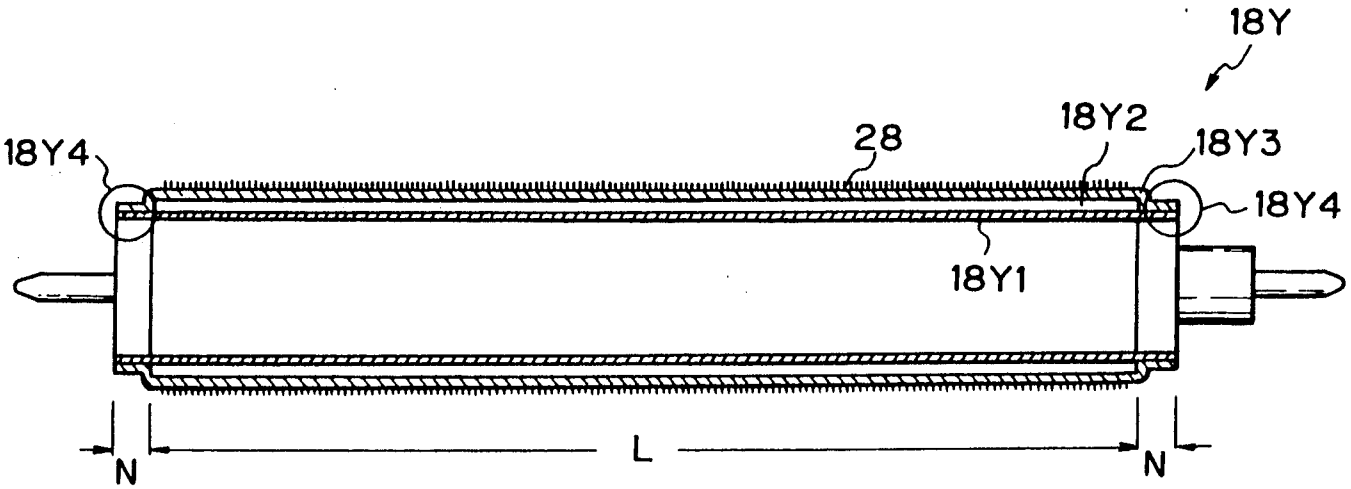
FIG. 5 is a section showing a specific implementation for dissipating static electricity developed on the surface of the developing roller to ground.

FIG. 5 shows a specific implementation for surely releasing the static electricity which is developed on the surface of the conductive coating 18Y3 of the developing roller 18Y to ground. As shown, the insulating layer 18Y2 extends over an axial dimension of the roller 18Y that corresponds to an image forming area L of the drum 12, but it is absent in opposite end portions that correspond to non-image forming areas N defined at opposite ends of the image forming area L. Specifically, in the portions corresponding to the non-image forming areas N, the conductive coating 18Y3 immediately overlies the conductive base 18Y1 without the intermediary of the insulating layer 18Y2. In this configuration, static electricity developed on the coating 18Y3 is surely dissipated to ground via such opposite end portions, or ground portions, 18Y4. In FIG. 5, the reference numeral 28 designates the magnet brush formed on the surface of the developing roller 18Y.

While the present invention has been shown and described in relation to a developing roller incorporated in a developing unit of a color developing device, it may of course be implemented as a cleaning sleeve of a cleaning device of the type cleaning a photoconductive element by use of a magnet brush. Further, the present invention is applicable not only to a color electrophotographic copier shown and described by also to other various kinds of image forming apparatuses using an electrophotographic procedure.

In summary, in accordance with the present invention, a bias being applied for development to a developing roller, or developer carrier, of a developing device is prevented from leaking to the outside due to scratches or similar defects of the surface of a photoconductive element, or image carrier. While a developing device having a plurality of developing units is in operation, a magnet brush is prevented from being formed on the developing rollers of the developing units which are not operative. Hence, the present invention eliminates the replacement or repair of a photoconductive element otherwise needed to prevent the bias from leaking.

Various modifications will become possible for those skilled in the art after receiving the teachings of the present disclosure without departing from the scope thereof.

What is claimed is:

1. A magnet brush forming agent carrier having a surface for allowing a magnet brush forming agent to form a magnet brush thereon, comprising:

a non-magnetic conductive base;

a first layer formed on said base and having a predetermined insulation resistance; and a second layer formed on said first layer for defining said surface of said magnet rush forming agent carrier and having a predetermined insulation resistance;

wherein said second layer has a function of dissipating static electricity deposited on said surface.

2. A carrier as claimed in claim 1, wherein a total insulation resistance of said first and second layers is $10^7$ ohms.

3. A carrier as claimed in claim 1, wherein said first layer comprises an insulating layer having a resistance greater than $10^6$ ohms, said second layer comprising a coated layer having a resistance of $10^4$ to $10^9$ ohms.

4. A carrier as claimed in claim 3, wherein said first layer has an insulation resistance of $10^9$ ohms while said second layer has an insulation resistance of $10^6$ ohms.

5. A carrier as claimed in claim 3, wherein said second layer comprises a conductive layer and a binding layer for binding said conductive layer to said insulating layer.

6. A carrier as claimed in claim 5, wherein said conductive layer is thicker than said binding layer.

7. A carrier as claimed in claim 6, wherein said conductive layer is 25 to 35 microns thick while said binding layer is 15 to 25 microns thick.

8. A carrier as claimed in claim 1, wherein said second layer is directly formed on at least a part of said base without the intermediary of said first layer.

9. A carrier as claimed in claim 8, wherein said part of said base constitutes a grounding portion connecting to ground.

10. A carrier as claimed in claim 1, wherein the magnet brush forming agent comprises a developer, said carrier comprising a developing roller located to face an image carrier which is to carry an electrostatic latent image to be developed.

11. A carrier as claimed in claim 10, wherein said part of said base on which said second layer is directly formed corresponds to a non-image forming area of said image carrier.

12. A carrier as claimed in claim 11, wherein said portion corresponding to said non-image forming area constitutes a grounding portion for connecting said developing roller to ground.

13. A carrier as claimed in claim 11, wherein the magnet brush forming agent comprises a cleaning agent, said carrier comprising a cleaning sleeve.

14. In a multi-color developing device having at least two developing units for developing latent images electrostatically formed on an image carrier by using developers of at least two colors, said developing units each comprising a developer carrier for carrying a magnet brush formed by particular one of said developers, wherein said developer carriers each comprises a non-magnetic conductive base, a first layer formed on said base and having an insulation resistance greater than $10^6$ ohms, and a second layer formed on said first layer and having an insulation resistance ranging from $10^4$ to $10^9$ ohms, such that said magnet brush is formed only on the developer carrier of an operative developing unit.

* * * * *